United States Patent [19]

Grabner

[11] Patent Number: 4,865,247

[45] Date of Patent: Sep. 12, 1989

[54] FOLDING MAILER

[75] Inventor: Werner Grabner, Rödermark/Waldacker, Fed. Rep. of Germany

[73] Assignee: Panocard International Establishment, Balzers, Liechtenstein

[21] Appl. No.: 168,373

[22] Filed: Mar. 15, 1988

[30] Foreign Application Priority Data

Mar. 28, 1987 [DE] Fed. Rep. of Germany ... 8704650[U]

[51] Int. Cl.[4] ..... B42D 15/08

[52] U.S. Cl. ..... 229/92.1; 229/92.8

[58] Field of Search ..... 229/92.1, 92.3, 92.8

[56] References Cited

U.S. PATENT DOCUMENTS

| | | | |
|---|---|---|---|
| 225,319 | 3/1880 | Barton | 229/92.1 |
| 576,552 | 2/1897 | Cook | 229/92.1 |
| 861,747 | 7/1907 | Mitchell | 229/92.1 |
| 1,708,574 | 4/1929 | Hazen | 229/92.3 |
| 2,279,164 | 4/1942 | Gettleman | 229/92.8 |
| 2,723,078 | 11/1955 | Tilly | 229/92.8 |
| 3,197,121 | 7/1965 | Hayes | 229/92.1 |
| 4,660,856 | 4/1987 | Shacklett | 229/92.1 |
| 4,681,253 | 7/1987 | Engelhardt | 229/92.8 |

*Primary Examiner*—Stephen P. Garbe

*Attorney, Agent, or Firm*—Felfe & Lynch

[57] ABSTRACT

A folded mailer having panels laid one on the other on fold lines on a paper sheet divided by a middle and two other fold lines parallel to one another and parallel to shorter sides into four panels including two and panels end two middle panels. At least the two middle panels are of approximately equal size. The two end panels are folded at the two other fold lines over their adjacent middle panels. The two end panels and the two middle panels are so folded at the middle fold line that the two end panels lie on one another. At least one of the surfaces of the two end panels has thereon a releasing adhesive. A panoramic scene extends over all four panels and on a surface of the end panels which is folded against a surface of the middle panels over which the panoramic scene extends.

3 Claims, 5 Drawing Sheets

Figure 1:
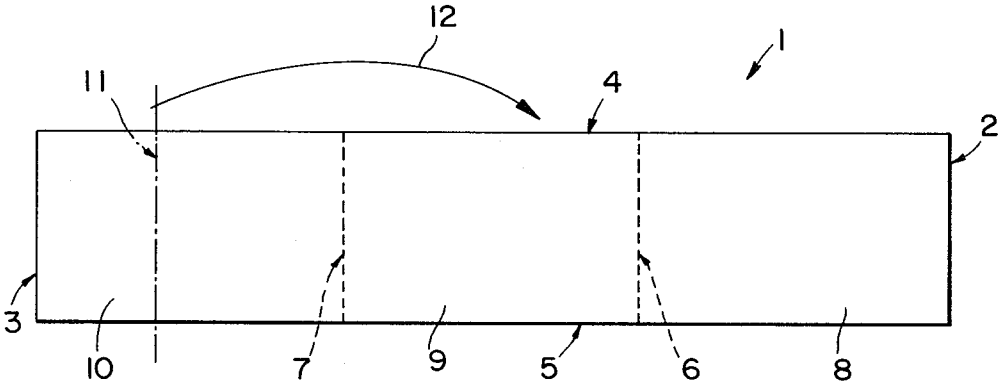

FIG.7
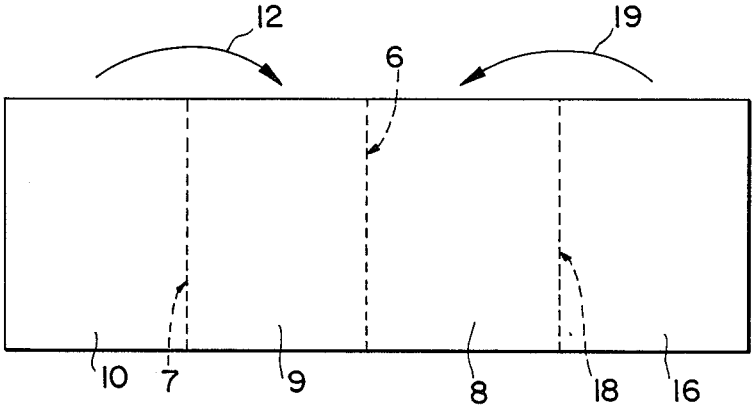
FIG.8
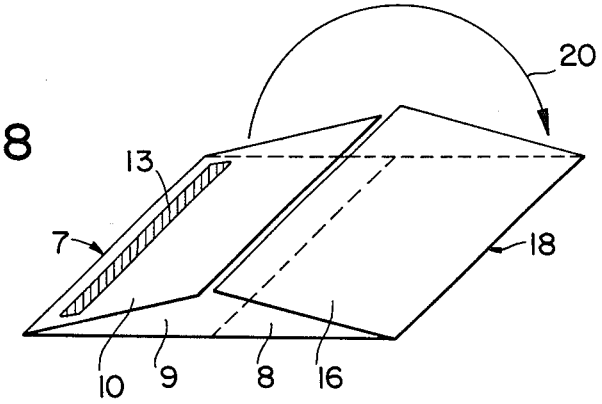
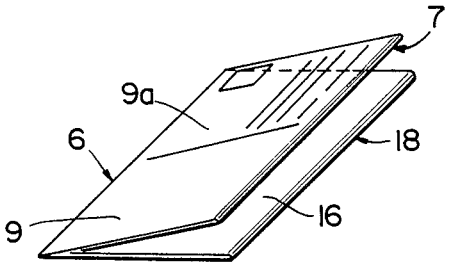
FIG.9

FOLDING MAILER

The subject of this Gebrauchsmuster is a folding mailer having sides which can be laid one on the other by folding on fold lines and cemented to one another at least spot-wise, which in the folded state complies with postal regulations.

The profiles and weights per unit area of such mailers are established by national and international postal regulations. Depending on the dimensions of the mailers and how they are sealed, they are classified as postcards, letters or printed matter. In the case of mailers consisting of several panels, care must be taken that no other pieces of mail will be able to become caught in the mailer.

DE-GM 74 24 156 discloses a postcard of the kind described above, in which the folding is performed on a fold line running parallel to one of the shortest sides of the piece of paper that is used, and divides it into areas which are in a proportion of about 1 : 2 to one another. The writing surface formed thereon is closed by folding down the smaller panel whose outside edge falls on the center of the format that is determined by the outlines of the postcard.

Afterward, the junction at the terminal edge of the smaller panel is permanently sealed.

The total surface area that is available on the mailer, however, is limited to one and one-half times the surface area of a normal postcard.

It is therefore the aim of this invention to devise a mailer of the kind described above, in which a substantially larger surface area will be available for writing and/or printing, and which will nevertheless satisfy the postal regulations.

The solution of the stated problem is accomplished according to the invention, in the case of the mailer referred to above, in that a sheet of paper with a minimum weight of 100 g/m$^2$ is divided by at least two fold lines parallel to one another and to the shorter sides of the sheet into a corresponding number of panels of which at least two panels directly abutting one another at a fold line are of about equal size, at least one of the surfaces that will lie directly one on the other after the last folding being provided with at least one coat of a releasing adhesive at at least one external edge. Such a mailer consequently has twice the size of a mailer corresponding to postal regulations, plus the area that is made available by the at least one additional panel. Such a mailer is quite outstandingly suitable for writing and/or imprinting with panoramic scenes, city maps or extracts from city maps, for using a portion of the surface as a reply card, and also for making sealable writing surfaces available.

By using a paper with a specific weight of at least 100 g in conjunction with the above-described folding and the releasing adhesive a mailer is obtained with a minimum weight of 200 g/m$^2$, which can be considered to be of high quality as regards its handling characteristics.

The fold lines are to consist of such deformations of the paper as will permit reliable folding at the intended place. The fold lines can therefore be constituted by creases, perforations or incisions, for example. If a panel or a portion of a panel is to be separated from the mailer, the separation can be marked for a scissor cut.

The "releasing adhesive" is a preferably transparent material that is applied to an area and which permits resealing virtually as often as desired. The pattern of application of such an adhesive, which can be applied to one side only or to both sides in mirror-image relationship, can be based on practical considerations. In an especially advantageous manner, the adhesive will be applied in the area of those outer edges which belong to surfaces of panels which in the final folding will come to lie directly on one another.

It is especially advantageous for the sheet of paper to be divided by three fold lines into four panels of which at least the two inner panels are of equal size, and at least one of the surfaces of the two outer panels that will be face to face after folding is completed is provided with at least one coat of a releasable adhesive.

The outer panels can at the same time be made shorter without impairing the quality of the seal by the adhesive; only a portion of the surface is lost.

It is therefore especially advantageous if all four panels are of approximately equal size. In this manner a mailer is created whose weight per unit area, considered all in all, corresponds to four times the specific weight of the paper used, i.e., it has a specific weight of at least 400 g/m$^2$. Since the total area of the mailer is, however, correspondingly small, the total weight of the mailer can still be kept under 20 grams, so that the lowest postage rate will be applicable.

It is furthermore particularly advantageous if an additional coat of a releasing adhesive bearing an adhering object is situated on a panel surface that will be on the inside in the folded state. This adhering object can be, for example, a reply card, a sample (textile sample), a photograph or the like.

Figure 2:
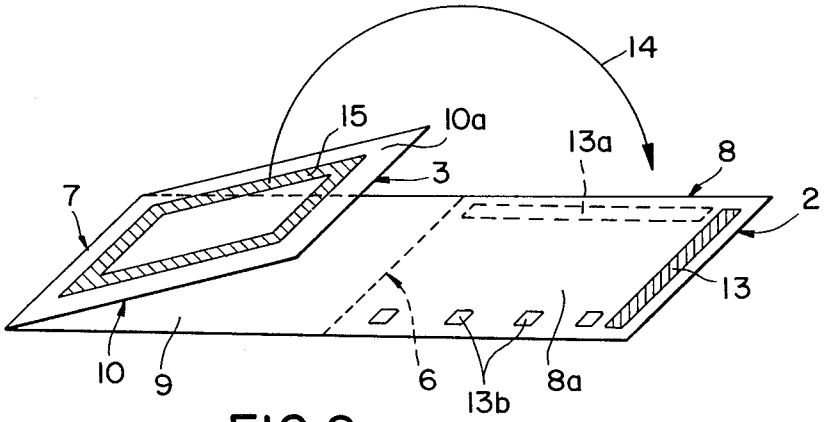
Figure 3:
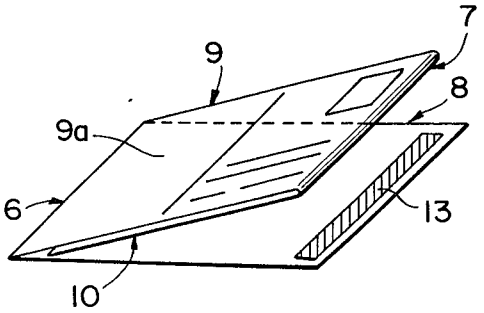
Figure 4:
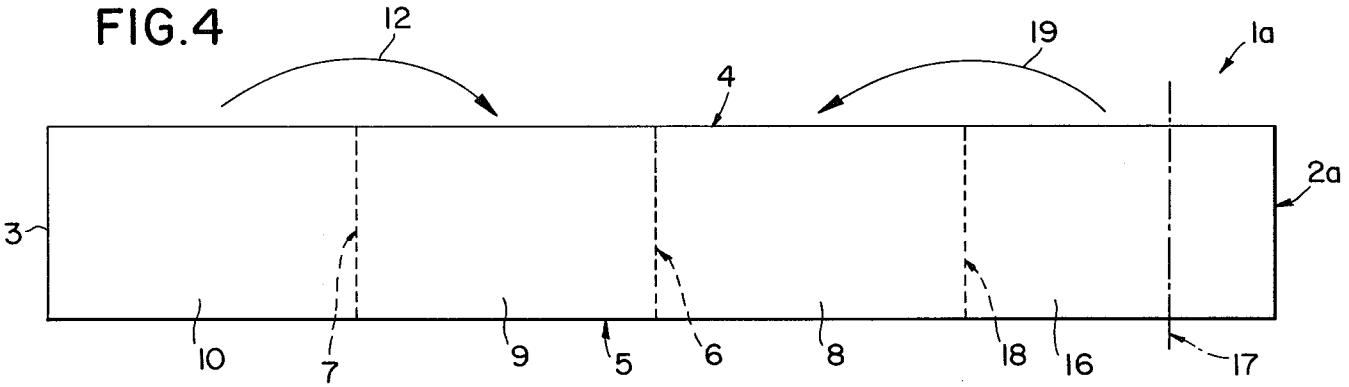
Figure 5:
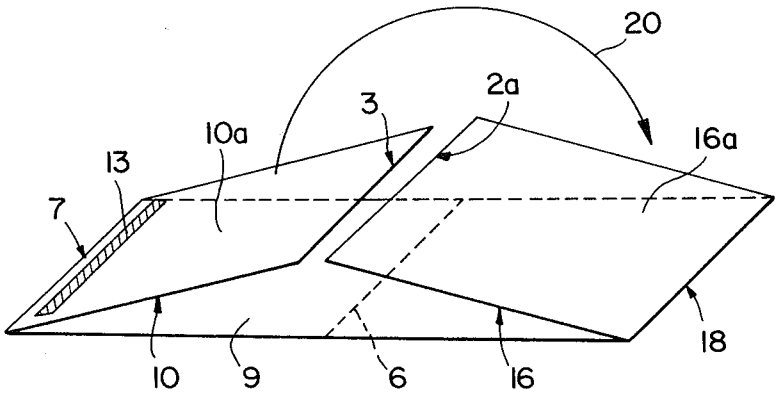
Figure 6:
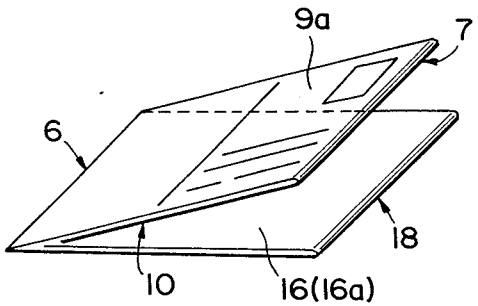
Figure 10:
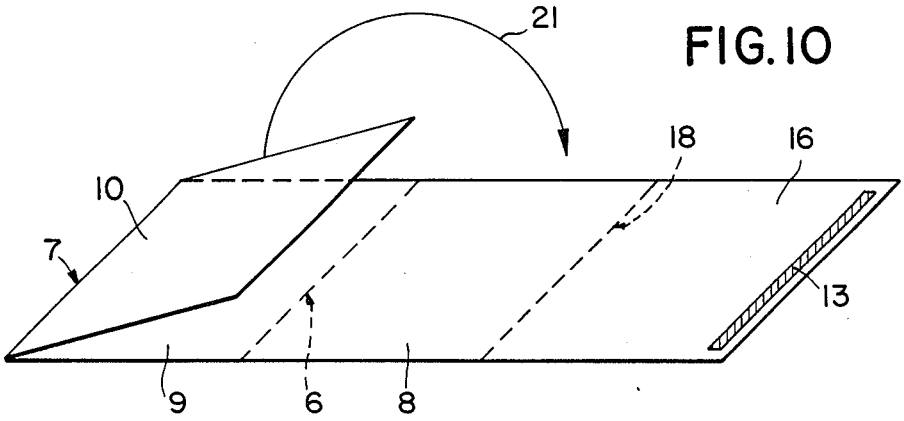
Figure 11:
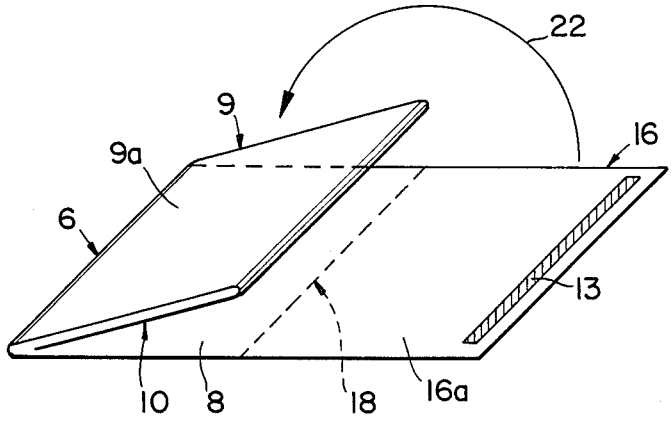
Figure 12:
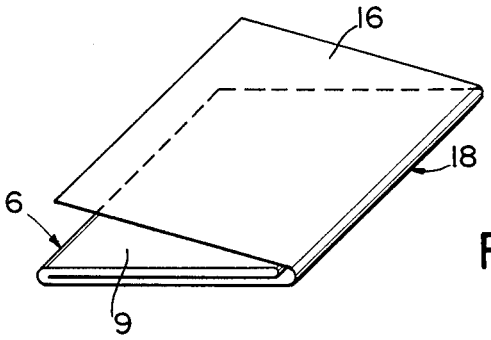

Four different embodiments of the subject matter of the gebrauchsmuster will be explained below with the aid of FIGS. 1 to 12, wherein FIGS. 1 to 3 show a first embodiment having three panels which in the transverse ["landscape"] format meet at two fold lines, FIGS. 4 to 6 show an additional embodiment having four panels which in the "landscape" format meet at three fold lines, FIGS. 7 to 9 show an additional embodiment having four panels which in the vertical ["portrait"] format meet at three fold lines, FIGS. 10 to 12 show an additional embodiment having four panels which are folded together all in the same direction.

Figure 13:
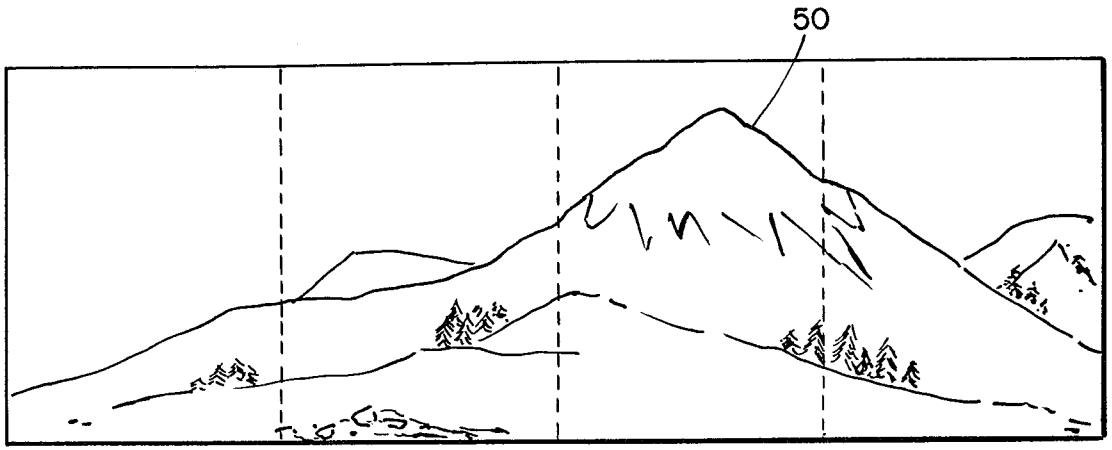

FIG. 13 shows an embodiment similar to FIGS 7–9 but having a panoramic scene extending over all four panels and on a surface of the end panels which is folded against a surface of the middle panels over which the panoramic scene extends.

In FIG. 1 there is shown a paper sheet 1 which has two short sides 2 and 3 and two long sides 4 and 5. The paper has two fold lines 6 and 7 which are parallel to one another and to the short sides 2 and 3. By these fold lines three panels 8, 9 and 10 are formed, on which the directly abutting panels 8 and 9 are rather precisely of the same size, while the third panel 10 can also be made shorter, i.e., can terminate at the dash-dotted line 11.

By folding panel 10 on the fold line 7 in the direction of the arrow 12, the paper sheet can be converted to a three-dimensional shape according to FIG. 2. The fold line is now contained in a crease. The surface **10*a* that was in the back in FIG. 1 is now facing up. On the inner surface 8*a* of panel 8 there is a coating 13 of a repeatedly releasable and repeatedly readhering adhesive, the coating 13 being in the form of a narrow strip running parallel to an outside edge which in this case is identical with the short side 2 of the sheet. If by a final folding in the direction of the arrow 14 around the fold line 6 the paper 1 is converted to the shape shown in FIG. 3, the surfaces 8***a* and 10*a* will lie against one another with the adhesive (coating 13) between them. The surface 9*a* of panel 9, which was in the back in FIG. 1, is on the outside facing up in FIG. 3. A slight pressure on surface 9*a* will suffice to join together the two panels 8 and 10 releasably together in the area of the coating 13. Since the panels 9 and 10 are joined together at the fold line 7 now forming a folded edge, the top panel 9 is thus also reliably joined to panel 8 enclosing panel 10. As represented in FIG. 3, the surface 9*a* of the center panel is provided with a conventional printed form satisfying postal purposes.

In any case it can clearly be seen that the surfaces 8*a* and 10*a* are the surfaces of panels 8 and 10 which will face one another after the final fold, with the inclusion of the partial coating 13. In any case, the reference to the folding action constitutes not just working instructions but also and chiefly a description of the physical form.

From FIG. 2 it is apparent also that the adhesive coating 13 can be situated not just in the area of one edge which is identical with the short side 2 of the sheet, but also, or alternatively, in the area of an edge which coincides with the long side 4 of the sheet. Such a possibility is indicated by the area 13*a* within the broken lines. In such a case a second coat of a releasing adhesive is to be provided at the opposite edge.

It is, however, also shown that the coating of releasing adhesive does not need to be continuous, but that it can also be divided into individual areas 13*b* without thereby defeating the overall purpose.

In FIG. 2 it is furthermore shown that, on a surface that will be on the inside in the folded state, namely on the surace 10*a* of panel 10, an additional coating 15 of a releasing adhesive is situated, on which an object (reply postcard, sample, photograph, etc.), which is not represented, can be releasably fastened. In this manner the mailer additionally serves the function of an envelope, i.e., the object referred to cannot come loose accidentally from the mailer.

In FIG. 4, parts that are the same as before are provided with the same reference numbers, so that repetition is unnecessary. The paper sheet la, however, is prolonged to the right by an additional panel 16, which can also be shortened, i.e., can terminate at the dash-dotted line 17. The additional panel 16 is joined to panel 8 at an additional fold line 18. In any case the panels 8 and 9 abutting one another directly at the fold line 6 are of substantially the same size, so that by folding on the line 6 the folded edges (FIG. 5) formed at the fold line 6 (FIG. 5) will come to lie one on the other.

To prepare the four-part mailer according to FIGS. 4 and 5 the procedure is as follows: First the outer panels 10 and 16 are folded on the fold lines 7 and 18 in the direction of the arrows 12 and 19, until the shape represented in FIG. 5 is achieved. The coat 13 of releasing adhesive is in this case on the surface 1O*a* of the panel 10 (this could also or alternatively be the case with the subject of FIG. 2). The short sides 2*a* and 3 in this case come to lie close to the fold line 6. The statement that, in the special case represented, all four panels are of approximately equal size allows for the fact that, as the folding continues to the form shown in FIG. 6, the short sides 2*a* and 3*a* must not collide with one another so as to buckle the panels 10 and 16.

The surface 16*a* of panel 16, which was on the back in FIG. 4, will be facing up in the form reached in FIG. 5. If now, setting out from the state shown in FIG. 5, the mailer already doubled on both sides is now folded on the fold line 6 to the form shown in FIG. 6, the surfaces 10*a* and 16*a* of the two outer panels 10 and 16 ill in this final folding come in contact with one another enclosing the coating 13 of releasing adhesive. Here again a slight pressure on the surface 9*a* will suffice to seal reliably the article shown in FIG. 6. In this embodiment the alternative possibilities exist for providing different coatings of a releasing adhesive as shown in FIG. 2.

FIGS. 7 to 9 show the situation in the case of a mailer which differs from the one in FIGS. 4 to 6 only in that the individual panels 8, 9, 10 and 16 are joined together in the vertical or "portrait" format (instead of the landscape format) by fold lines 6, 7 and 18. Consequently, the same reference numbers are retained, and the description of FIGS. 4 to 6 is in every way applicable. From FIG. 9 it can be seen that the postal address imprint on the surface 9*a* has been rotated by 90 degrees to allow for the portrait format of the individual panels. In this case too the sealed folding card satisfies postal regulations.

FIGS. 10 to 12 show an additional possibility for the folding of the paper la according to FIG. 4, which is provided when the fold lines 6, 7 and 18 are slightly shifted and arranged so that the individual panels have a surface magnitude that increases slightly from one short side of the sheet to the other. Now the folding begins by first folding in the smallest panel.

Thus, in FIG. 10, first panel 10 is folded on the fold line 7 onto the panel 9. Then the combined panels 9 and 10 are together folded on the fold line 6 onto panel 8 in the direction of the arrow 21. FIG. 11 shows the procedure just before the end position is reached. Although folding could continue in the same direction, panel 16 is then folded on fold line 16 in the direction of the arrow 22, until the surfaces 9*a* and 16*a* lie flat against one another enclosing the coating 13. The state just before this final position is reached is represented in FIG. 12. Now a slight pressure on panel 16 will suffice to close the mailer reliably according to FIG. 12. The surface of panel 16 that faces up in FIG. 12 can then serve for the printing of the postal address form.

If in the case of the embodiment according to FIGS. 10 to 12 a panoramic photograph extends over all of the panels, the coating 13 would of course be applied to the photograph, and this might be undesirable in spite of the transparency of this coating. On the other hand, the embodiment according to FIGS. 4 to 6 and 7 to 9 has the advantage that the area running across all inner surfaces of all panels is free of any adhesive.

I claim:

1. A folded mailer having panels laid one on the other by folding on fold lines, comprising:

a paper sheet with a minimum weight of 100 g/m$^2$ divided by a middle and two other fold lines parallel to one another and parallel to shorter sheet sides into four panels comprising two end panels and two middle panels, at least the two middle panels being of approximately equal size, the two end panels being folded at the two other fold lines over their adjacent middle panels, respectively, and the two end panels and the two middle panels being so folded at the middle fold line that the two end panels lie on one another;

at least one of the surfaces of the two end panels which lie on one another having thereon a releasing adhesive; and a panoramic scene extending over all four panels and on a surface of the end panels which is folded against a surface of the middle panels over which the panoramic scene extends.

2. A folded mailer in accordance with claim 1 in which all four panels are of about equal size.

3. A folder mailer in accordance with claim 1 in which the releasing adhesive is close to a fold line.

* * * * *